US010472832B2

(12) United States Patent
Halischuk

(10) Patent No.: US 10,472,832 B2
(45) Date of Patent: Nov. 12, 2019

(54) KITS OF PARTS FOR TRIMMING STEP EDGES

(71) Applicant: Cory Halischuk, Clandeboye (CA)

(72) Inventor: Cory Halischuk, Clandeboye (CA)

( * ) Notice: Subject to any disclaimer, the term of this patent is extended or adjusted under 35 U.S.C. 154(b) by 0 days.

(21) Appl. No.: 15/794,453

(22) Filed: Oct. 26, 2017

(65) Prior Publication Data

US 2018/0305935 A1 Oct. 25, 2018

Related U.S. Application Data

(63) Continuation-in-part of application No. 15/654,260, filed on Jul. 19, 2017, now abandoned, which is a continuation-in-part of application No. 14/753,208, filed on Jun. 29, 2015, now Pat. No. 9,719,262.

(51) Int. Cl.

| | |
|---|---|
| ***E04F 11/16*** | (2006.01) |
| ***E04F 11/17*** | (2006.01) |
| ***F21V 33/00*** | (2006.01) |
| *E04F 19/06* | (2006.01) |
| *E04F 11/104* | (2006.01) |
| *F21S 4/20* | (2016.01) |
| *F21Y 103/10* | (2016.01) |
| *F21Y 115/10* | (2016.01) |

(52) U.S. Cl.

CPC ..... *E04F 11/166* (2013.01); *E04F 11/17* (2013.01); *E04F 11/175* (2013.01); *F21V 33/006* (2013.01); *E04F 11/16* (2013.01); *E04F 19/06* (2013.01); *E04F 2011/1048* (2013.01); *F21S 4/20* (2016.01); *F21Y 2103/10* (2016.08); *F21Y 2115/10* (2016.08)

(58) Field of Classification Search

CPC ..... E04F 11/16; E04F 11/175; E04F 11/17; E04F 2011/1048; E04F 19/06; F21V 33/006; F21S 4/20; F21Y 2103/10; F21Y 2115/10

See application file for complete search history.

(56) References Cited

U.S. PATENT DOCUMENTS 1,561,668 A * 11/1925 Stanwood ..... B61D 23/00 280/169

4,285,177 A * 8/1981 Seegers ..... E04F 11/025 428/688

(Continued)

*Primary Examiner* — Phi D A

(74) *Attorney, Agent, or Firm* — Adrian D. Battison; Ade & Company Inc.; Ryan W. Dupuis

(57) ABSTRACT

An apparatus for trimming step edges includes a nose piece for locating at an edge of a horizontal existing surface, a covering board for covering the horizontal existing surface, and a riser board for locating a top of the riser board at or adjacent the edge with the board in an upright orientation. The nose piece includes at its rear a recess for receiving a projecting tongue of the covering board, which cooperate to retain the covering board positioned against the existing surface. The apparatus additionally features a fastener projecting forwardly at a bottom of the tongue for mechanically coupling with a distinct locking recess in the nose piece. The apparatus also features a receptacle for placing at a rear of the covering board to receive another riser board, which conceals a gap between the rear edge of the covering board and an upright surface upstanding from the existing surface.

5 Claims, 11 Drawing Sheets

(56) References Cited

U.S. PATENT DOCUMENTS

| | | | | | |
|---|---|---|---|---|---|
| 4,455,797 | A * | 6/1984 | Naka | E04F 11/163 | 52/179 |
| 4,905,431 | A * | 3/1990 | Davis | E04F 11/16 | 52/177 |
| 5,103,608 | A * | 4/1992 | Andreo | E04F 11/166 | 52/179 |
| 5,190,799 | A * | 3/1993 | Ellingson, III | E04F 15/10 | 15/215 |
| 5,587,218 | A * | 12/1996 | Betz | A47G 27/0293 | 15/215 |
| 5,806,253 | A * | 9/1998 | Nelson | E04F 11/166 | 52/179 |
| 6,115,975 | A * | 9/2000 | Abdollahi | E04F 11/163 | 52/179 |
| 6,230,385 | B1 * | 5/2001 | Nelson | E04F 19/062 | 29/450 |
| 6,774,066 | B1 * | 8/2004 | Souza | B32B 15/04 | 138/99 |
| 6,895,622 | B2 * | 5/2005 | Szekely | E01C 11/24 | 14/69.5 |
| D621,961 | S * | 8/2010 | Gardner | | |
| 8,505,250 | B2 * | 8/2013 | Vanhastel | E04F 11/175 | 52/179 |
| 8,850,757 | B2 * | 10/2014 | Gardner | E04F 11/166 | 52/179 |
| 9,770,383 | B1 * | 9/2017 | Meyers | A61H 3/066 | |
| 2006/0201093 | A1 * | 9/2006 | Stanchfield | E04D 1/365 | 52/459 |
| 2008/0280097 | A1 * | 11/2008 | Flaherty | E01C 5/20 | 428/131 |
| 2014/0283468 | A1 * | 9/2014 | Weitzer | E04F 11/108 | 52/177 |

* cited by examiner

KITS OF PARTS FOR TRIMMING STEP EDGES

This application is a continuation-in-part of U.S. patent application Ser. No. 15/654,260 filed Jul. 19, 2017, which is a continuation-in-part of U.S. patent application Ser. No. 14/753,208 filed Jun. 29, 2015 now issued as U.S. Pat. No. 9,719,262.

FIELD OF THE INVENTION

This invention relates to an apparatus or a kit of parts for trimming step edges for example a tread of a staircase, a step at an edge of a sunken floor, or a top edge of a short wall. In all these examples there is a tread or horizontal surface, a vertical riser meeting the horizontal surface, and a nose portion joining the vertical and horizontal surfaces.

BACKGROUND

Known constructions of staircase nose pieces may have potential shortcomings.

The applicant provides a unique solution for staircase nose pieces and more generally for apparatus for trimming step edges that improves upon existing constructions of same.

SUMMARY OF THE INVENTION

It is one object of the invention to provide an improved arrangement for trimming step edges for example a tread of a stair case, a step at an edge of a sunken floor or a top edge of a short wall.

According to an aspect of the invention there is provided an apparatus for trimming a step edge for example a tread of a staircase, a step at an edge of a sunken floor, or a top edge of a short wall, comprising:

a riser board for locating a top of the riser board disposed in upright orientation at or adjacent an edge of a substantially horizontal existing surface defining said step edge;

an elongate member forming a nose piece for locating at the edge of the existing surface, the member including a top, a rear for facing towards the step edge, and a front ornamental face that is opposite the rear;

a covering board for covering the existing surface;

the covering board having a top wear surface, a bottom surface for facing the existing surface, a front edge for locating proximal the member, and a rear edge for locating distal to the member;

the member being arrangeable in a mounted position in which the top of the member is spaced above the existing surface such that a thickness of the covering board is locatable between the top of the member and the existing surface;

the member including a recess in the rear that is spaced from the top so as to leave an upper portion of the rear of the member between the recess and the top for locating at a height of the existing surface in the mounted position of the member;

the recess having a base spaced inwardly from the rear and a top sidewall extending from the base to the rear of the member for receiving the covering board having at its front edge a tongue spaced below the top wear surface and projecting forwardly of a front end of the top wear surface, such that the recess and tongue cooperate to retain the covering board positioned against the existing surface.

The nose piece and the riser board may be provided as a preassembled unit, that is as two separately manufactured pieces which are joined together, for example by adhesive, or as a unitary construction.

In one arrangement, the recess includes a bottom sidewalk opposite the top sidewall such that there is defined a groove in the member.

Thus, typically there is left a portion of the member below the groove and above a substantially horizontal surface which is located in abutment with a top of the riser board.

In another arrangement, the rear of the member is stepped downwardly and inwardly from the top to a bottom of the member so that a lower portion of the rear of the member is spaced inwardly from the base of the recess so that there is formed a substantially horizontal surface extending from the base inwardly towards a surface of the lower portion.

In such an arrangement, the nose piece member can be mounted with the lower portion of its rear in abutment with an outer face of the riser board so that the horizontal surface which extends inwardly from the base of the recess to the surface of the lower portion is located in abutment with a top of the riser board.

Preferably, the apparatus also includes a stop for locating at or adjacent the rear edge of the covering board in spaced relation to the member so as to confine horizontal movement of the covering board between the recess of the member and the stop.

Typically, the stop forms an upstanding surface for butting engagement with the rear edge of the covering board.

Preferably, the apparatus further includes a receptacle for receiving another upright riser board at the rear edge of the covering board and locatable to conceal a gap between the rear edge of the covering board and an upright surface upstanding from the existing horizontal surface.

In one arrangement, the receptacle comprises a bottom from which side walls extend upwardly in diverging fashion to receive the riser board.

As such, the bottom of the riser board may be wedged between the tapering side walls so as to fixedly locate the riser board in the receptacle without fastening thereto.

Preferably, the receptacle comprises a bottom surface for butting engagement with the top wear surface of the covering board such that the receptacle can be arranged in a position overlapping the top wear surface so as to retain the covering board against the existing horizontal surface.

In one arrangement, the covering board comprises a metallic covering material defining the top wear surface, and a wooden base material spanning from the rear edge to the front edge of the covering board and defining the tongue.

For example, the metallic covering material is aluminum which is powder coated.

In one arrangement, the bottom surface of the covering board is defined by foam material.

In one arrangement, there is provided a fastener connected to the covering board and projecting forwardly of the front edge thereof for cooperation with a locking recess formed in the rear of the member, which is distinct from the recess for receiving the tongue, to mechanically couple the covering board and the member. That is, typically the recess receiving the tongue primarily acts to resist lifting of the front edge of the covering board while the covering board and the nose piece member remain mechanically disconnected. As such, the fastener cooperating with the locking recess acts to mechanically couple or interconnect the covering board and nose piece member.

Preferably the fastener comprises a base strip having a forward edge spaced forwardly from the tongue and supporting on an upper surface and a lower surface of the base a respective deflectable projection upstanding from that surface which can deflect relative to the base strip in at least a rearward direction so as to deflect during insertion into but resist removal from within an interior space defined by the locking recess.

According to another aspect of the invention there is provided an apparatus for trimming a step edge for example a tread of a staircase, a step at an edge of a sunken floor, or a top edge of a short wall, comprising:

a riser board for locating a top of the riser board disposed in upright orientation at or adjacent an edge of a substantially horizontal existing surface defining said step edge;

an elongate member forming a nose piece for locating at the edge of the existing surface, the member including a top, a rear for facing towards the step edge, and a front ornamental face that is opposite the rear;

a covering board for covering the existing surface;

the covering board having a top wear surface, a bottom surface for facing the existing surface, a front edge for locating proximal the member, and a rear edge for locating distal to the member;

the member being arrangeable in a mounted position in which the top of the member is spaced above the existing surface such that a thickness of the covering board is locatable between the top of the member and the existing surface;

the member including a locking recess in the rear that is spaced from the top so as to leave an upper portion of the rear of the member between the recess and the top for locating at a height of the existing surface in the mounted position of the member;

the locking recess having a base spaced inwardly from the rear of the member, a top sidewall extending from the base to the rear of the member, and a bottom sidewall opposite the top sidewall;

and a fastener connected to the covering board and projecting forwardly of the front edge thereof at a location spaced below the top wear surface for cooperation with the locking recess to mechanically couple the covering board and the member;

the fastener comprising a base strip having a forward edge spaced forwardly from the front edge of the covering board and supporting on a surface extending therebetween at least one deflectable projection upstanding from the surface which can deflect relative to the base strip in at least a rearward direction so as to deflect during insertion into but resist removal from within an interior space defined by the locking recess.

Preferably the fastener is located at a bottom of the tongue and projects forwardly of the tongue, and the locking recess in the member is located at a bottom end of the recess and includes a base of the locking recess which is spaced inwardly from the base of the recess and a top sidewall of the locking recess spanning therebetween.

In one arrangement the fastener is adapted for frictional engagement with the locking recess which also includes a bottom sidewall.

The bottom sidewall of the locking recess may be formed by a top edge of the riser board arranged in fixed relation to the member in an upright mounting condition in which the riser board is in the upright orientation and the top of the riser board is located beneath the recess in the member.

Preferably the deflectable projection includes a leading front surface and trailing rear surface extending from the surface of the base strip and meeting at a free edge of the projection, the leading front surface and the trailing rear surface being inclined relative to the surface of the base strip in a rearward direction of the covering board.

According to another aspect of the invention there is provided an apparatus for trimming a step edge for example a tread of a staircase, a step at an edge of a sunken floor, or a top edge of a short wall, comprising:

a riser board for locating a top of the riser board disposed in upright orientation at or adjacent an edge of a substantially horizontal existing surface defining said step edge;

an elongate member forming a nose piece for locating at the edge of the existing surface, the member including a top, a rear for facing towards the step edge, and a front ornamental face that is opposite the rear;

a covering board for covering the existing surface;

the covering board having a top wear surface, a bottom surface for facing the existing surface, a front edge for locating proximal the member, and a rear edge for locating distal to the member;

the member being arrangeable in a mounted position in which the top of the member is spaced above the existing surface such that a thickness of the covering board is locatable between the top of the member and the existing surface;

and a receptacle which is arranged to receive another riser board for locating at or adjacent the rear edge of the covering board in spaced relation to the member to conceal a gap between the rear edge of the covering board and an upright surface upstanding from the existing horizontal surface.

Preferably, the receptacle forms a trough including a bottom from which side walls extend upwardly in diverging fashion to receive the riser board.

Preferably, the receptacle comprises a bottom surface for butting engagement with the top wear surface of the covering board such that the receptacle can be arranged in a position overlapping the top wear surface to retain a rear of the covering board on the existing surface.

That is, in the overlapping position the receptacle acts to resist movement of the covering board transverse to the existing surface.

Preferably, the apparatus also includes a stop for locating at or adjacent the rear edge of the covering board beneath the receptacle so as to confine horizontal movement of the covering board between the member and the stop.

Preferably, the stop forms an upstanding surface for butting engagement with the rear edge of the covering board.

The stop may be formed from extruded aluminum.

According to a further aspect of the invention there is provided an apparatus for trimming a step edge comprising:

- a vertical riser board meeting a horizontal existing surface at or adjacent an edge of the existing surface;
- a facing material covering the riser board;
- an elongate member forming a nose piece above the facing material for mounting at the edge of the existing surface, the member having:
  - a vertical rear surface along the riser board;
  - a front face defining an attractive face that is opposite the rear surface;
  - a horizontal top surface extending between the rear surface and the front face;
  - an upper edge at a junction of the top surface and the front face;
  - a lower edge at a bottom of the front face along the facing material;
  - a continuously longitudinally extending groove in the front face of the member, the groove having:
    - a base recessed from the front face;

a first side edge in the front face of the member at a position spaced from the upper edge of the member and a second side edge on said front face at a position spaced from the lower edge of the member;

a first side wall extending from the base to the first side edge and a second side wall extending from the base to the second side edge; and a series of screws in the groove at spaced positions along the base thereof;

the screws fastening the member in a mounted position in which the top surface of the member is spaced above the existing surface such that a thickness of a covering material which is disposed on the existing surface for covering the existing surface is located between the top surface of the member and the existing surface.

In the embodiment as described in more detail hereinafter, the apparatus or kit of parts for trimming step edges may be suited for installation independent of an attractive covering material (e.g., cladding) for covering the existing surface. Also, the nose piece is shaped so as to cooperate with the riser board and the facing material covering the riser board so as to provide a clean, attractive appearance. Furthermore, placement of the screws in the groove for fastening the member in its mounted position enhances the clean, attractive appearance.

Note that 'contiguous' as used herein means 'touching or connected throughout in an unbroken sequence'.

Preferably, the member further includes a rear flange portion at a top of the rear surface that protrudes beyond the rear surface at a position spaced above the existing surface and an upper surface of the rear flange portion defines a continuation of the top surface. It is preferred that the riser board extends above the existing surface such that the rear flange portion of the member is disposed over a top of the riser board. In a preferred arrangement, the rear flange portion resides on the top of the riser board. Preferably, the riser board has an outer face which is covered by the facing material and an opposing inner face, and a free end of the rear flange portion and the inner face of the riser board are substantially flush in a vertical plane.

Preferably, the member further comprises a cutaway portion at a bottom of the rear surface that has an inner end surface which is recessed from the rear surface towards but spaced from the front face so as to form a lip at the bottom of the front face such that the facing material is received in the cutaway portion and the lip overlaps an outer face of the facing material. It will be appreciated that 'cutaway' as used in this specification refers to a shape of the member and does not necessarily refer to a part of the member which has formed by cutting away part of the member.

Preferably, the front face is inclined in a vertical direction from the lower edge to an intermediary location between the lower and upper edges such that the intermediary location on the front face is forwardly proud of the lower edge.

In other words, it is preferred that the front face comprises a lower face portion which is inclined in the vertical direction between the lower edge and an intermediary location between the lower and upper edges such that the intermediary location is forward of the lower edge and an upper face portion which extends from the intermediary location towards the upper edge. Preferably, the groove is located in the lower face portion so as to face downwardly.

Preferably, the screws are recessed in the groove from the front face of the member. Preferably, the apparatus includes a plastic strip inserted into the groove along a length of the board that covers the screws therein. Preferably, the plastic strip comprises a cap portion outside the groove and an insert portion extending into the groove. The cap portion has first and second side edges and an outer surface therebetween. The first side edge of the cap portion is located at a position spaced from the first side edge of the groove toward but spaced from the upper edge. Similarly, the second side edge of the cap portion is located at a position spaced from the second side edge of the groove toward but spaced from the lower edge. As such, preferably the cap portion covers the groove and the outer surface of the cap portion is contiguous with the front face. In one instance, the apparatus includes a lighting element arranged for generating light that is disposed in the groove so as to be located therein between the base of the groove and the plastic strip which is translucent for permitting passage of the light generated by the lighting element therethrough. In other embodiments, the plastic strip may also be transparent.

In one instance, the apparatus includes a lighting element arranged for generating light that is inserted in the groove for illuminating an area adjacent the edge of the existing surface. In this instance, the apparatus includes the lighting element without necessarily having the translucent or transparent plastic strip.

According to another aspect of the invention there is provided a method of forming a covering panel for trimming a tread of a staircase, the method comprising the steps of:

providing a base sheet of metallic material, the base sheet having:

a width and a length substantially equal to a width of the tread and a length thereof respectively; and an upper face for facing upwardly when the covering board is received on the tread;

providing at least one strip of metallic material which is sized smaller than the base sheet, each strip having an upper face for facing upwardly when the covering board is received on the tread and an opposite lower face;

bonding the lower face of the at least one strip to the upper face of the base sheet to substantially form the covering panel so that the at least one strip is fixedly located on the base sheet with its upper face spaced above the upper face of the base sheet, the step of bonding including:

applying adhesive at an interface between the lower face of the at least one strip and the upper face of the base sheet;

curing the adhesive at a baking temperature lying in a range between 200 and 600 degrees Fahrenheit.

In one arrangement the upper face of the base sheet is powder-coated prior to the step of the bonding.

In one arrangement the method further includes the step of powder-coating an upper surface of the covering board collectively defined by the at least one strip bonded to the base sheet, The baking temperature may lie in a prescribed range between 300 and 500 degrees Fahrenheit or between 350 and 450 degrees Fahrenheit.

The baking temperature may be a prescribed temperature of about 400 degrees Fahrenheit.

According to a further aspect of the invention there is provided an apparatus for trimming a step edge for example a tread of a staircase, a step at an edge of a sunken floor or a top edge of a short wall, comprising:

an elongate member forming a nose piece for mounting adjacent a horizontal existing surface at an edge of the existing surface, the member having:

an elongate member forming a nose piece for mounting adjacent a horizontal existing surface at an edge of the existing surface, the member having:

a vertical rear surface;

a front face defining an attractive face that is opposite the rear surface;

a horizontal top surface extending between the rear surface and the front face;

an upper edge at a junction of the top surface and the front face;

a lower edge at a bottom of the front face;

a continuously longitudinally extending groove in the front face of the member, the groove having:

a base recessed from the front face;

a first side edge in the front face of the member at a position spaced from the upper edge of the member and a second side edge on said front face at a position spaced from the lower edge of the member;

a first side wall extending from the base to the first side edge and a second side wall extending from the base to the second side edge; and a series of screws in the groove at spaced positions along the base thereof;

a lighting element arranged for generating light that is inserted in the groove for illuminating an area adjacent the edge of the existing surface.

The embodiment as described in more detail hereinafter provides a nose piece which has a clean, attractive appearance and augments safety of ascending or descending one or more steps in dimly lit environments.

Preferably, the screws are recessed from the front face. In one instance, the lighting element comprises a strip of light emitting diodes (LEDs) extending longitudinally along a majority of the length of the groove such that the screws in the groove are covered by the strip of LEDs.

When the screws are recessed from the front face, in one instance the apparatus includes a translucent plastic strip inserted into the groove along a length of the board that covers the screws and lighting element therein while permitting passage of light generated by the lighting element therethrough. In other embodiments, the plastic strip may also be transparent. When the apparatus includes the translucent plastic strip and the lighting element comprises the strip of LEDs, the strip of LEDs is located in the groove between the screws and the plastic strip.

Preferably, the front face is inclined from the lower edge to an intermediary location between the lower and upper edges such that the intermediary location is transversely outwardly proud of the lower edge thereby forming an inclined lower face portion and an upper face portion which extends from the intermediary location to the upper edge, and the groove is located in the lower face portion such that the lighting element is oriented downwardly for illuminating the area that is below the existing surface. When the front face is inclined such that the intermediary location on the front face is proud of the lower edge, in one instance the base of the groove is parallel to the front face at the lower face portion.

All or any of the above features may be combined.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
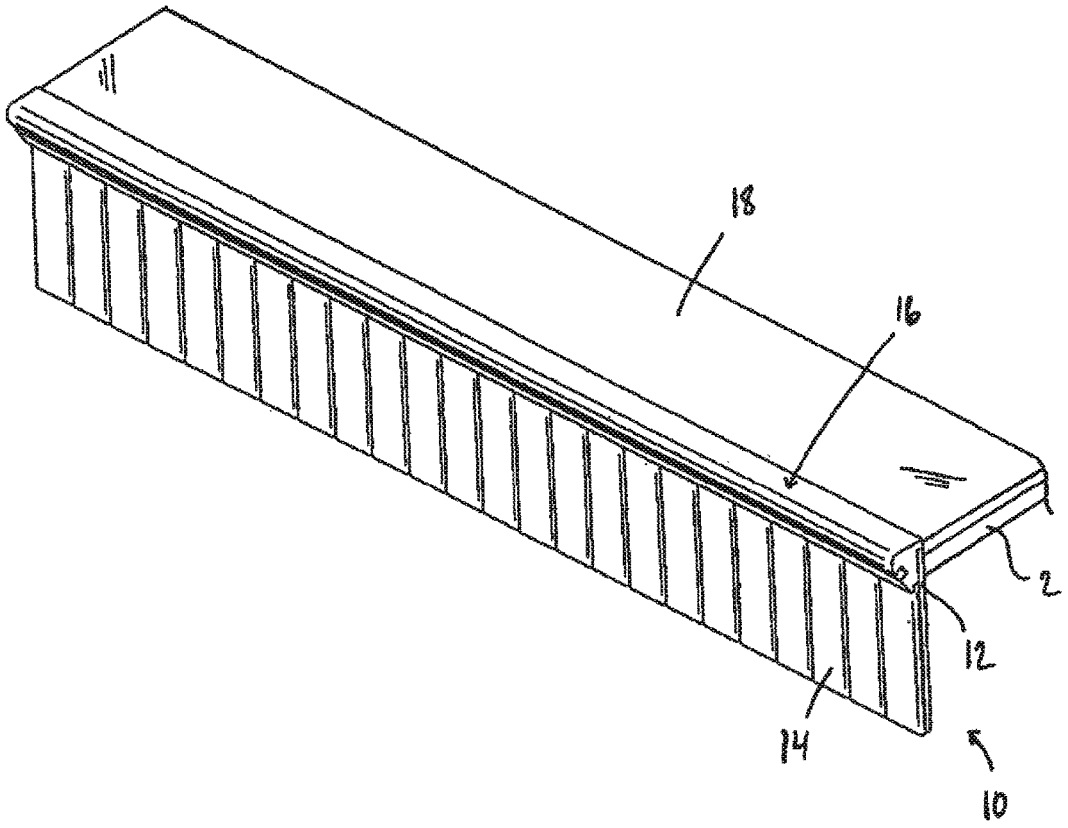
FIG. 1 is a perspective view of an embodiment of apparatus for trimming step edges according to the present invention, in which a lighting element and plastic strip are omitted for clarity of illustrating relative positions of each piece of the apparatus relative to a horizontal existing surface and an attractive cladding thereon.
Figure 2:
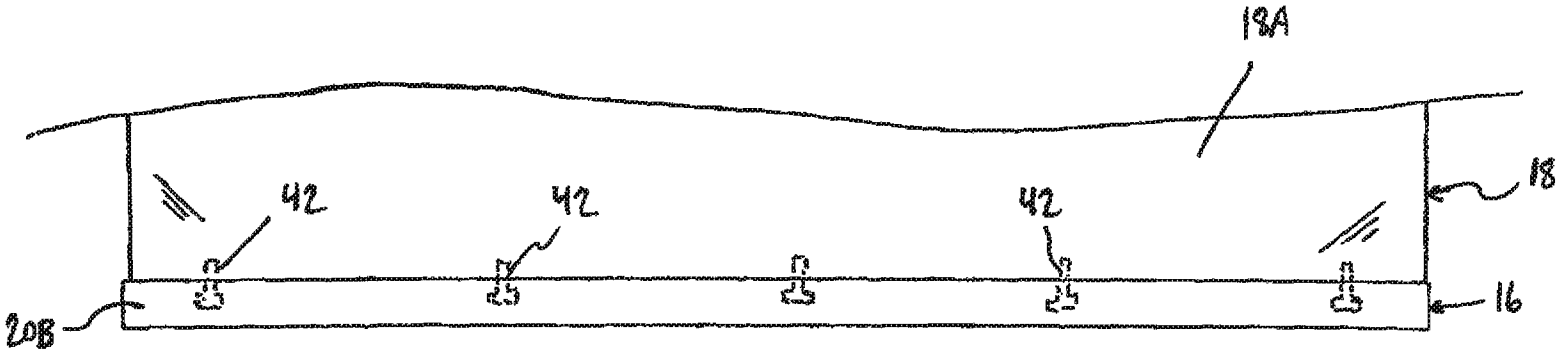
FIG. 2 is a top plan view of the embodiment of FIG. 1 schematically showing screws fastening the nose piece to a tread defining the existing surface.
Figure 3:
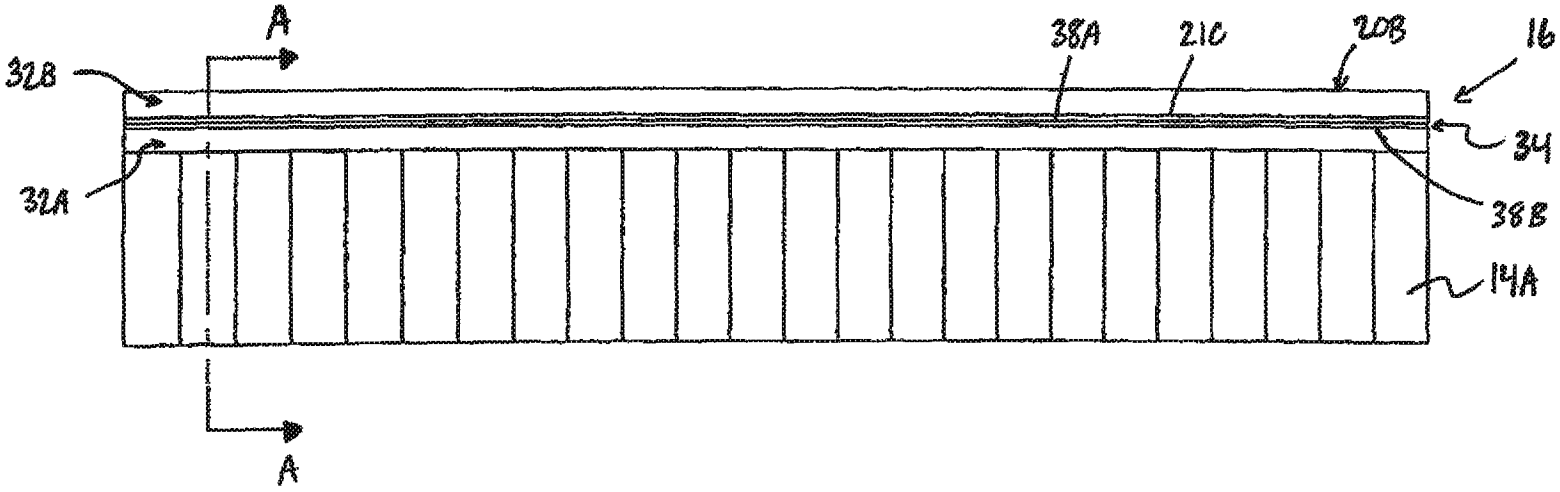
FIG. 3 is an elevation view of the embodiment of FIG. 1 omitting the lighting element and plastic strip that are inserted into the groove.
Figure 4:
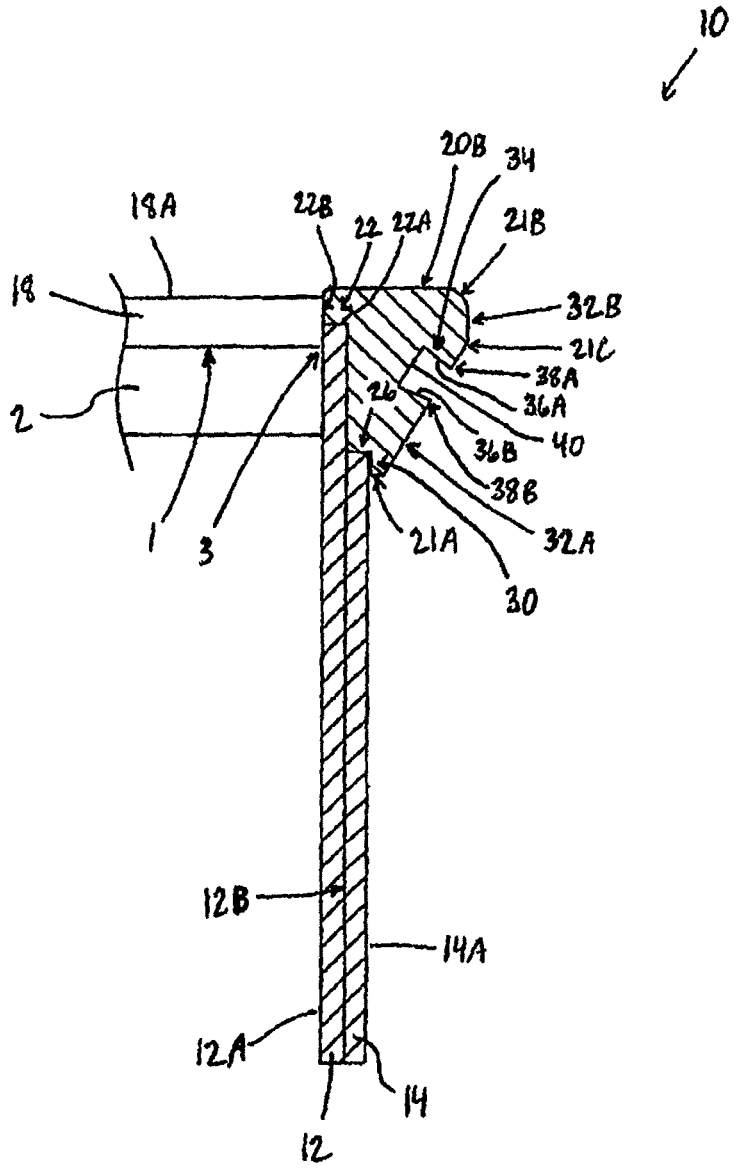
FIG. 4 is a cross-sectional view along line A-A in FIG. 3 omitting the lighting element and plastic strip that are inserted into the groove.

Referring to the accompanying figures there is illustrated an apparatus for trimming a step edge that is generally indicated by reference numeral 10. The step edge for which the apparatus 10 may be suited includes that of a tread of a staircase, a step at an edge of a sunken floor, or a top edge of a short wall. In the illustrated embodiment, a horizontal existing surface 1 is defined by an upper surface 1 of the tread 2 of the staircase.

As such, the apparatus 10 comprises a riser board 12 oriented vertically so as to meet the tread at a free tread edge 3 thereof. The free tread edge lies along a longitudinal reference axis which is used herein. In the illustrated embodiment, the riser board 12 is positioned and sized so as to extend above the upper surface 1 of the tread such that the riser board is in front of the tread and an inner surface 12A of the riser board is adjoining the upper surface 1 of the tread along the free tread edge 3. In alternative embodiments, the riser board may be positioned such that the inner surface is butting against the tread 2 and the riser board is sized such that a top of the riser board is below the upper surface 1 of the tread. In further alternative embodiments, the riser board may be positioned and sized such that an outer surface 12B is flush with the free tread edge 3 in a vertical plane which may be defined by the riser board (and more particularly, the vertical plane is defined by the outer surface 12B). For example, the riser board may be made of plywood.

Additionally, the apparatus 10 comprises a facing material 14 for covering the outer surface 12B of the riser board.

More specifically, the facing material 14 covers a lower surface portion of the outer surface 12B of the riser board as will become apparent later. The facing material provides an attractive and finished appearance to a riser of the step. For example, the facing material may comprise a wood veneer or a marble slab.

The apparatus 10 further includes a longitudinally elongate member 16 which forms a nose piece. As such, the member is referred to as the nose piece hereinafter. The nose piece 16 joins a vertical attractive surface defined by an outer surface 14A of the facing material 14 and a horizontal attractive surface defined by an upper surface 18A of a covering material 18 disposed on the existing surface 1 for covering same. For example, the covering material may comprise interlocking hardwood or laminate flooring pieces, a wooden slab, a marble slab, or a granite slab. The covering material 18 is not necessarily included as part of the apparatus 10 and may be sold separately therefrom.

The nose piece 16 has a rear surface 20A, a top surface 20B, and a front face 20C which defines an attractive face of the nose piece. The front face 20C has a lower edge 21A at a bottom of the front face and an upper edge 21B at a junction of the top surface 20B and the front face 20C. The upper edge 21B is rounded such that the junction of the top surface and front face is smooth.

The nose piece comprises a rear flange portion 22 at a top of the rear surface 20A so as to be opposite the upper edge 21B at the junction of the top surface 20B and the front face 20C. The rear flange portion 22 extends transversely of the rear surface 20A so as to protrude therefrom. The rear flange portion has a lower stepped surface 22A which is oriented perpendicularly to the rear surface 20B so as to form an upper shoulder 24 where the lower stepped surface and the rear surface converge. The rear flange portion also has a rear end surface 22B at a free end of the rear flange portion that is spaced transversely of the rear surface 20A and is in parallel relation to the rear surface. Note that the top surface spans from a front of the nose piece at the upper edge 21B to a rearmost end of the nose piece at the rear end surface 22B of the rear flange portion. As such, an upper surface portion of the rear flange portion 22 defines part of the top surface 20B.

Further to the rear flange portion, the nose piece comprises a cutaway portion 26 at a bottom of the rear surface 20A so as to be adjacent the lower edge 21A of the front face. The cutaway portion comprises an inner end surface 26A recessed transversely from the rear surface 20A toward but spaced from the front face 20C. The inner end surface 26A is parallel to the rear surface 20A. An upper stepped surface 26B of the cutaway portion 26 is oriented perpendicularly to both the rear surface 20A and the inner end surface 26A. A lower shoulder 28 is formed where the upper stepped surface 26B and inner end surface 26A converge.

The inner end surface 26A and a longitudinal bottom portion of the front face 20C form a lip 30 along the bottom of the nose piece.

Further to the lip, the front face 20C is inclined in a transverse direction from the lower edge 21A to the upper edge 21B. That is, the front face 20C is inclined from the lower edge 21A to an intermediary location 21C on the front face that is spaced from the upper edge 21B thereby forming an inclined lower face portion 32A between the lower edge and the intermediary location and an upper face portion 32B extending from the intermediary location 21C to the upper edge 21B. The intermediary location 21C is spaced further from the rear surface 20A than the lower edge 21B so as to be located transversely proud of the lower edge. The upper face portion 32B is parallel to the rear surface 20A.

The nose piece 16 also includes a continuously longitudinally extending groove 34 in the front face 20C of the nose piece. In the illustrated embodiment, the groove 34 is disposed in the lower face portion 32A of the front face. The groove comprises reverse tapered first and second side walls 36A, 36B leading from first and second side edges 38A, 38B respectively on the front face 20C to a base 40 recessed from the front face. As such, the spacing between the first and second side walls 36A, 36B of the groove increases towards the base 40. Furthermore, the first side edge 38A is located at a position spaced from the upper edge 21B and the intermediary location 210 so as to be between the intermediary location and the lower edge 21A, and the second side edge 38B is located at a position spaced from the lower edge 21A so as to be closer to the lower edge than the first side edge 38A is thereto. Moreover, the base 40 is oriented parallel to the front face 20C at the lower face portion 32A in the illustrated embodiment.

Turning now to a collective arrangement of the apparatus 10, the riser board 12 is installed vertically upright at the free edge 3. Typically, the facing material 14 is fastened to the riser board, which may be effected by an adhesive such as glue. The nose piece 16 is positioned against the riser board 12 above the facing material 14, with the rear flange portion 22 residing on the top of the riser board 12 so as to be thereover. Thus, the lower stepped surface 22A of the rear flange portion overlaps the top of the riser board in butting engagement therewith. As such, the rear surface 20A of the member is oriented vertically and is in butting engagement with the outer surface 12B of the riser board. Furthermore, the facing material 14 is received in the cutaway portion 26 such that the upper stepped surface 26B of the cutaway portion is in butting engagement with a top of the facing material 14 and the lip 30 overlaps an outer face 14A of the facing material. The lip 30 may be suited for retaining the facing material 14 in its position covering the riser board 12.

A series of screws 42 are received in the groove 34 at spaced positions along the base 40 of the groove for mounting the member 16. The screws are recessed in the groove from the front face 20C. In the arrangement shown in FIGS. 1-5, the screws pass through the rear surface 20A of the member 16, through the riser board 12 and into the tread. In this manner, the screws 42 support the nose piece 16 in its mounted position as better shown in FIGS. 1 and 5.

In the mounted position, the rear surface 20A is fastened to the riser board 12. The screws of the illustrated arrangement of FIGS. 1-5 also fasten the riser board 12 to the tread 2. Furthermore, the rear end surface 22B of the rear flange portion is flush with the inner surface 12A of the riser board in a vertical plane defined by the inner surface 12A of the riser board in the illustrated embodiment. Additionally, the top surface 20B is oriented horizontally and presented at a position spaced above the upper surface 1 of the tread 2 so that the covering material 18 may be disposed on the upper surface 1 of the tread 2 in a height between the top surface 20B and the upper surface 1 of the tread. The covering material along its thickness fits within the height between the top surface 20B of the nose piece and the upper surface of the tread. In other words, a thickness of the covering material, as measured between the upper surface 18A of the covering material and an opposing lower surface thereof which is in contact with the upper surface 1 of the tread 2, is located between the top surface 20B of the member and the existing surface when the covering material 18 is disposed on the tread 2. As such, the upper surface 18A of the covering material is located (at an elevation) between the top surface 20B of the nose piece and the upper surface 1 of the tread 2. Thus, the top surface 20B of the nose piece and the upper surface 18A of the covering material are contiguous. A flat end 44 of the covering material 18 abuts the rear end surface 22A of the rear flange portion. The flat end 44 of the covering material also abuts the inner surface 12A of the riser board in the illustrated embodiment. Adhesive may be added between the lower surface of the covering material 18 and the upper surface 1 of the tread suited for fastening of the covering material thereto; however, it will be appreciated that adhesive between these two surfaces is not required. As such, the mounted position of the nose piece 16 may be suited for retaining the covering material 18 in its installed position on the upper surface 1 of the tread. The screws 42 and shaping of a rear of the nose piece 16 including the rear flange portion 22, rear surface 20A, and lip 30 cooperatively with the riser board 12 and facing material 14 may be suited for supporting the nose piece 16 in its mounted position as clearly shown in FIG. 5. Furthermore, the illustrated arrangement of FIGS. 1-5 provides an apparatus for trimming step edges in which the covering material may be installed on the existing surface 1 (i.e., the upper surface of the tread of the illustrated embodiment) independent of the nose piece 16, riser board 12, and facing material 14. It will be appreciated that the covering material 18 and nose piece 16 do not necessarily have to be shaped (as, for example, with a cooperating ridge and channel on each respective component) to cooperate together for fastening the covering material and nose piece; however, in other embodiments, the nose piece 16 and covering material 18 may comprise such cooperating elements such as a ridge on one of the nose piece and covering material and a channel in another one of the nose piece and covering material for cooperatively fastening together.

Figure 5:
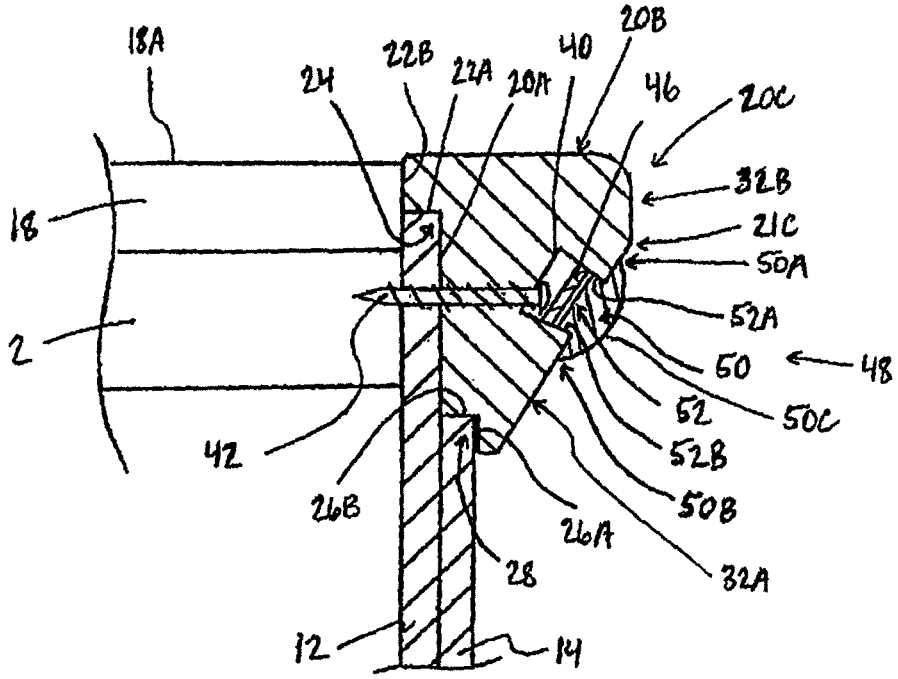
FIG. 5 is an enlarged cross-sectional view along line A-A in FIG. 3 emphasizing an interface between components at a top of the apparatus and schematically illustrating the lighting element and plastic strip.

Further to the screws, a lighting element 46 shown schematically in FIG. 5 is inserted in the groove 34. The lighting element 46 is arranged for generating light so as to be suited for illuminating an area adjacent the free tread edge 3. Since the groove 34 is disposed in the lower face portion 32A, the illuminated area lies below the upper surface 1 of the tread 2. In the illustrated embodiment, the lighting element comprises a strip of LEDs (in other words, a LED strip). The LED strip 46 extends longitudinally along the length of the groove so as to cover the screws 42 therein. Furthermore, the LED strip is connected to its power source (not illustrated). Such LED strips are known in the art and thus not described in detail herein.

A translucent plastic strip 48 is inserted into the groove 34 along the length of the nose piece 16. As such, the lighting element 46 is sandwiched generally between the base 40 of the groove and the plastic strip 48. In other words, the lighting element is disposed in between or intermediate the base of the groove and the plastic strip. Depending on an extent to which the screws 42 protrude from the base 40, the lighting element 46 may be sandwiched between the screws 42 and the plastic strip 48. In the illustrated embodiment, the plastic strip covers the groove 34 and the screws 42 and lighting element 46 therein; however, the plastic strip is translucent as mentioned before so as to be arranged to permit passage of the light generated by the lighting element 46 through the plastic strip for illuminating the area adjacent the tread.

The plastic strip 48 has a cap portion 50 outside the groove 34 and an insert portion 52 extending into the groove. Respective side edges of the insert portion cooperate with the first and second side walls 36A and 36B of the groove 34 to restrain the insert portion against movement out of the groove. The cap portion 50 has first and second side edges 50A, 508 and an outer surface 50C therebetween. In the illustrated embodiment, the first side edge 50A of the cap portion is located on the front face 20C of the nose piece at a position spaced from the first side edge 38A of the groove toward but spaced from the intermediary location 21C on the front face. The second side edge 50B of the cap portion is located on the front face 20C of the board at a position spaced from the second side edge 38B of the groove toward but spaced from the lower edge 21B. Thus, the plastic strip 48 covers the groove 34 and the outer surface 50C of the cap portion is contiguous with the front face 20C. Moreover, the outer surface 50C of the cap portion is domed in transverse cross-section so as to extend transversely proud of the front face 20C. The domed outer surface 50C of the cap portion tapers to a sharp edge at the front face 20C. In other embodiments, the insert portion 52 of the plastic strip may comprise arrow shaped fins engaging side walls of the groove 34.

Note that in other embodiments the rear surface may be fastened against the tread 2 so that the member is carried by the screws at the tread.

Also, in alternative embodiments, the upper surface 18A of the covering material may be coplanar with the top surface 20B of the nose piece so as to lie in a common horizontal plane.

In the embodiment illustrated in FIGS. 6-8 which is indicated 10', nose piece 16' includes a vertical rear surface 20A' and at the top thereof a rear flange portion 22' which has a recess 60 at a spaced location below the top surface 20B of the nose piece. As such, there is left an upper portion of a rear of the nose piece between the recess and the top of the member 16' that protrudes rearwardly past a base 62 of the recess. The recess 60, which spans the full length of the nose piece so as to be open at either end, has a vertically oriented base 62 which is spaced inwardly from a vertical rearmost surface 22B' of the rear flange portion 22' to which it is parallel, with an upper or top sidewall 64 spanning horizontally from the base 62 to the rearmost surface 22B'. Thus, top sidewall 64 meets the base 62 of the recess at a right angle in the illustrated embodiment of FIGS. 6-8. Further to the top sidewall 64 is a bottom sidewall 65 opposite thereto and extending from the recess base 62 at a right angle towards the rear of the nose piece 16'. Thus is formed an elongate groove with a base 62 and opposite sidewalls 64, 65 in the rear of the nose piece.

In this embodiment, a covering board 18' defining the ornamental tread of the staircase, which has a front edge 66 for locating proximal the nose piece and a rear edge 67 for locating distal to the nose piece, also includes a tongue 69 at its front edge for locating in the recess 60 of the nose piece 16'. The tongue 69 is spaced below a top wear surface 18A' of the covering board that faces away from the horizontal existing surface defined by a top of structural tread 2' when the covering board is installed to cover same. The tongue 69 projects forwardly beyond the front edge 66 of the covering board which is defined by covering material 72, along the full length of the board 18' in the illustrated embodiment, so as to form with the front edge 66 a ledge 74 on top of which a stop can be located.

It will be appreciated that "structural tread" and "structural riser" refer to a base or frame of the staircase on top of which the apparatus of the present invention is disposed in order to trim the staircase.

As such, during formation of the ornamental portion of the staircase, the tongue 69 of the covering board 18' and the recess 60 of the nose piece are mated in an interlocking arrangement, with the tongue received in the recess so that a free edge 77 of the tongue is in abutment with the base 62 of the recess, and the top sidewall 64 overlaps a top surface 78 of the tongue such that the rear flange portion 22' of the nose piece prevents against lifting of a front end of the covering board 18' and acts to prevent forward movement of the tread covering board 18'. Further, the front edge 66 defined by the covering material 72 is located in abutment with a top surface of the rear of the nose piece defined in the illustrated embodiment by the rearmost surface 22B' of the rear flange portion.

The opposite sidewall 64, 65 of the recess serve to locate the covering board 18' in height or elevation above the existing horizontal surface defined by the structural tread 2'. As such, the bottom sidewall 65 of the recess overlaps a bottom surface 79 of the tongue, and the tongue 69 is substantially sandwiched between the sidewalls 64, 65 of the recess.

From an end of the bottom sidewall 64 that is distal to the base 62, there is another vertical rear surface 23' which is coplanar with the rearmost surface 22B' of the rear flange portion and which spans from the bottom sidewall 65 to a horizontally oriented riser limiting surface 80, which abuts a top edge 82 of riser board 12' when the nose piece is mounted in abutment with an outer face 14A' of the riser board. The riser limiting surface 80 spans between the surface 23' and the rear surface 20A' of the nose piece which abuts an outer face 14A' of the riser board 12'. There is thus left a portion of the nose piece opposite to the upper portion, which is above the recess between same and the nose top surface 20B, that is below the recess 60 or groove.

Opposite the nose piece 16' there is provided a stop 84 located generally at or adjacent the rear edge 67 of the covering board 18' so as to be spaced rearwardly from the nose piece 16' acting to retain a common covering board, at the rear of which the stop 85 is located. Thus, the stop 85 acts to confine horizontal movement of the covering board 18' between the stop and the nose piece 16'. Typically, the stop 85 is located in such a manner that there is no horizontal movement in fore-and-aft directions allowed for the covering board. In the illustrated embodiment more clearly shown in FIG. 7, a finishing nail forms the stop 84 defining at its front an upstanding surface 84A for butting engagement with the rear edge 67 of the covering board 18'. Once the covering board 18' is disposed on the structural tread 2' with the tongue 69 received in the recess 60 of the nose piece, the stop 84 is driven into the tread 2' so that an upper portion protrudes above the existing surface defined by the tread, thereby being presented in a position for abutting the rear edge 67 of the board 18'. It will be appreciated that a plurality of the covering boards 18' for use on a common structure may be manufactured with some variation in their depth from front to rear edge. Thus, since the stop is a wholly distinct from the other components of the apparatus 10', it may be readily located immediately adjacent the rear edge of the board so that each covering board, which may be slightly different in size, is held tightly in interlocking fashion within the recess 60.

Further to the stop, there is provided a receptacle 85 for receiving a riser board of a next step in the staircase, that is of the adjacent step in an upward direction from that to which the ornamental tread belongs, of which the stop confines horizontal movement.

More specifically, the receptacle 85 forms an elongate trough 86 spanning a full length of the riser board, with a bottom wall 87, a front sidewall 88 and a rear sidewall 89, the inner surfaces of which (88A, 89A) extend upwardly from a bottom surface 87A in diverging fashion. As such, upon inserting a riser board into the trough with some down force applied in doing so to fixedly locate it between the side walls 88, 89, the side walls 88 and 89 which are resiliently deformable act to snugly retain the riser board 12' therein. That is, the inner surfaces of the front and rear wall are spaced apart, nearer the bottom of the trough, at a distance smaller than the thickness of the riser board 12' such that insertion of the riser board past a location where the spacing between the walls is substantially less than the thickness of the board acts to spread or deflect these surfaces away from one another so that the board can be accepted therebetween. By their resiliency to return to their original locations, the front and rear walls hold the board snugly in the trough. Alternatively, as shown at the clip indicated at 85', the riser board may be inserted only so far into the receptacle, until the bottom of the board reaches the depth in the trough whereat the inner surfaces of the front and rear walls are spaced apart by a thickness substantially equal to the thickness of the board thereby holding the riser board firmly in the receptacle, in which case the walls can be non-resilient. As such, the riser board is wedged between the tapering side walls 88, 89 of the receptacle and is held therein without fastening thereto, whether by for example mechanical fasteners or adhesive. In the illustrated embodiment, the front wall 88 is shorter than the rear wall 89, which is abutted against a riser R of the base frame of the staircase, and has an ornamental outer face which is curved forwardly and downwardly from a top edge of the front wall. The rear wall 89 is concealed by the riser board received in the receptacle of the stop.

The rear side wall 89 of the receptacle 85 carries apertures located at 90 for receiving threaded fasteners F which act to anchor the receptacle 85 to the base structure of the staircase which is being trimmed by the apparatus of the present invention. Heads of the fasteners F are located at the rear side walls 89 so that the riser board 12' covers same when received in the receptacle. Thus, the fasteners F do not pass through the riser board.

The receptacle 85 further includes a bottom outer surface 91 extending from a forwardmost edge to a rearmost edge thereof so as to span a full depth from front to rear of the receptacle. The bottom outer surface 91 is located in abutment and in overlapping condition with the top wear surface 18A' of the covering board 18', as the receptacle is usually fastened in fixed location to the structure of the staircase such that the covering board 18' is fitted tightly in a thickness direction therebetween without ability to be moved in transverse directions to the horizontal existing tread surface, that is, by lifting up from the base tread.

Thus, the bottom outer surface 91 of the receptacle and the upstanding surface 84A of the stop collectively form a cap for receiving a rear of the covering board, interacting therewith in a similar manner as the rear flange portion 22' of the nose piece 16'.

The covering board 18' does not span from front to rear edge 66, 67 a full depth of the tread of the structural frame of the staircase, and for this reason the stop 84 is utilized to fix location of the board 18' on the existing horizontal surface, in cooperation with the nose piece 16'. Thus, a gap G is left between an upright outer surface upstanding from the existing horizontal surface defined by the riser R and the rear edge 67 of the covering board 18', where the stop is located in position abutting the covering board 18'. However, the receptacle 85 which is located at the rear edge of that covering board spans a full distance between the rear edge 67 of the board 18'to the riser R so as to close this gap G, and conceal same and the stop 84.

As a top of the covering board 18' is capped off both at the front and rear thereof, respectively by the nose piece 16' and the collective arrangement of the stop 84 and receptacle 85, the covering board itself does not have to be directly fastened to the structural tread, for example by adhesive or mechanical fasteners (e.g., nails, screws). Furthermore, fixed location of the covering board in the fore-and-aft directions is maintained by the cooperation of the upstanding surface 84A of the stop and the base 62 of the recess at the nose piece 16' such that horizontal movement in these directions is prevented. In order to replace a covering board, this may be easily done by removing the receptacle 85 overlapping it and then the stop 84 so that the board 18' can be slidably removed from within the recess 60.

Figure 6:
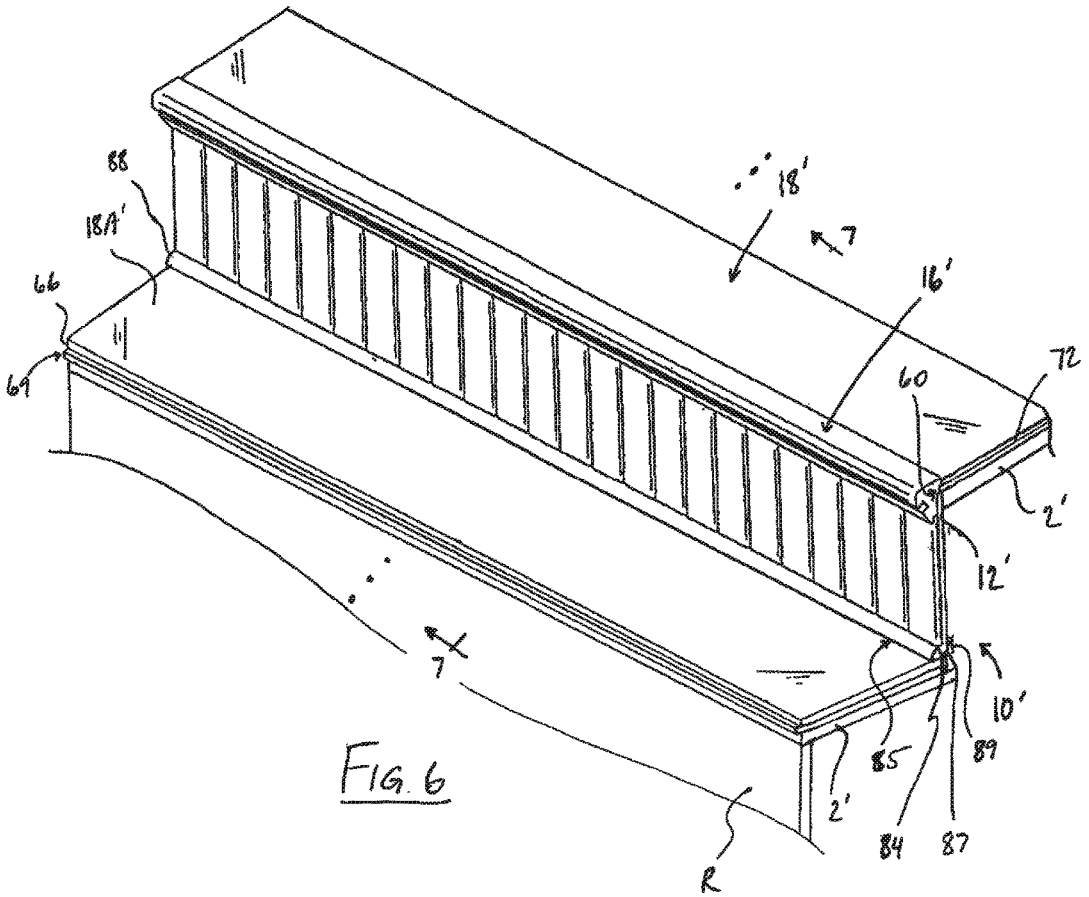
FIG. 6 is a perspective view of a second embodiment of apparatus for trimming step edges according to the present invention where some components are omitted for clarity of illustration.
Figure 7:
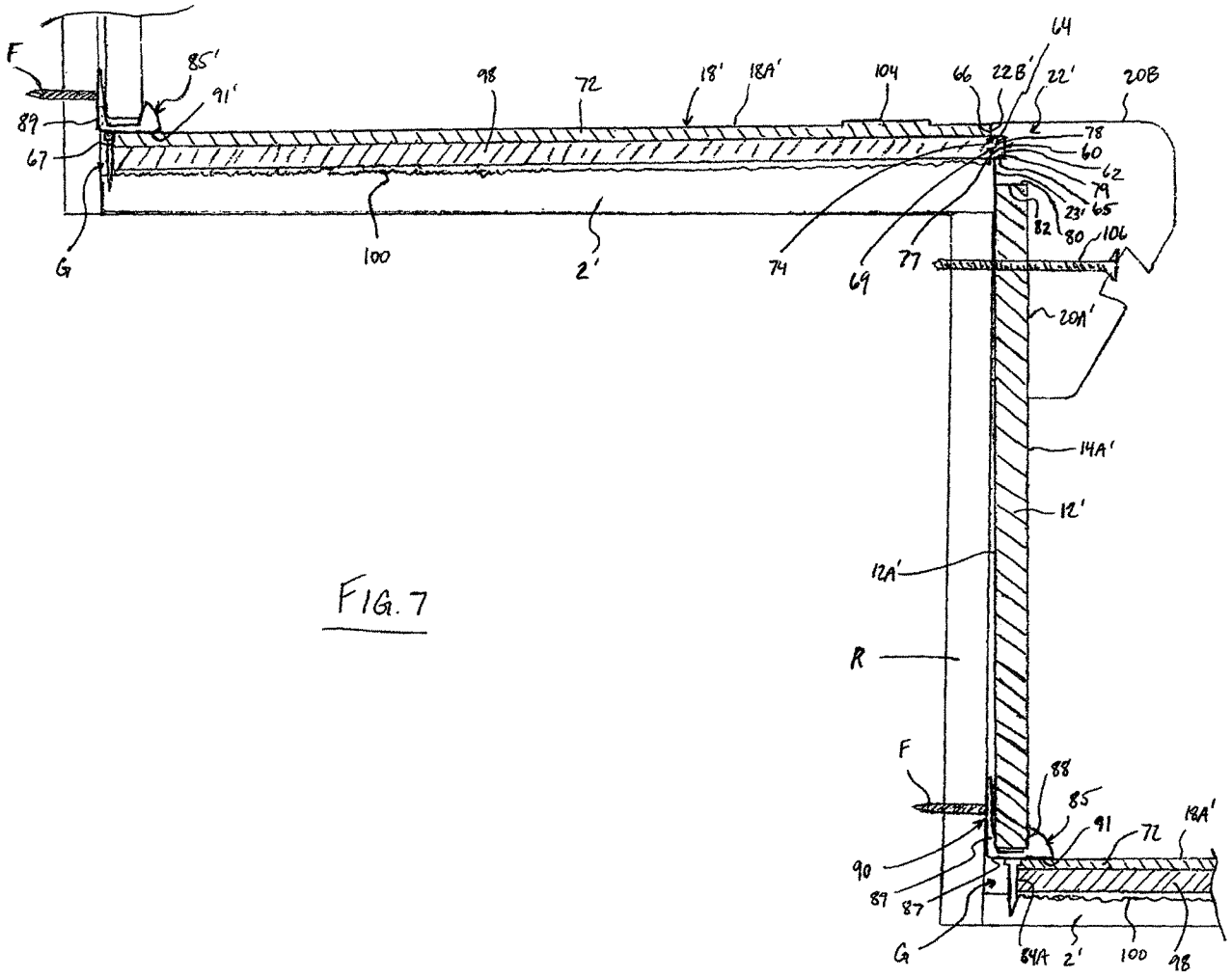
FIG. 7 is a cross-sectional view of the second embodiment as if it were taken along line 7-7 in FIG. 6.
Figure 8:
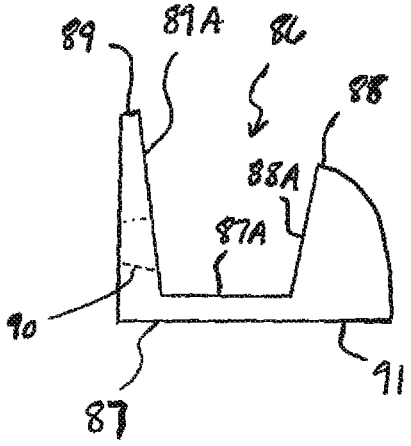
FIG. 8 is an end view of stop of the second embodiment of apparatus of FIG. 6.

The covering board 18' of the illustrated embodiment of FIGS. 6-8 comprises a metallic covering material 72, such as an aluminum panel which is powder coated to provide further traction, defining the top wear surface 18A', and in the illustrated embodiment the front edge 66, too. The covering board additionally comprises a wooden base material 98 beneath the covering material 72, for example 0.25 inches thick, spanning from the rear edge 67 to the front edge 66 of the covering board, and defining the tongue 69. A bottom surface of the wooden base material 98 is covered by foam material 100 which may enhance frictional engagement of the covering board 18' with the existing surface defined by the structural tread 2' of the staircase to resist horizontal movement of the board 18', particularly in directions parallel to the elongation of the nose piece and stop.

For further traction, an elongate raised ridge 104 is provided on the covering board 18', protruding above the top wear surface 18A' closer to the front edge 66 of the board than the rear edge 67.

In use, an installation of the apparatus of the embodiment of FIGS. 6-8 may begin at a bottom of the staircase by fastening a riser board 12' so as to be upstanding from a bottom landing, and then a nose piece at a top of the riser board 16'. The fasteners 106 mounting the nose piece 16' to the base of the staircase also pass through a thickness of the riser board 12' so as to hold a top thereof against the riser of the base staircase. In some arrangements, the riser board 12' and nose piece 16' may be a preassembled unit to reduce the number of separated components and accelerate installation of the apparatus 10'. The nose piece 16' is located in a height direction relative to the existing horizontal surface, defined by the tread 2', such that the recess 60 can accept a full thickness of the tongue 69 of the covering board that is to be subsequently installed.

With the riser board and nose piece fastened, the covering board of the step at which elevation the nose piece is located can be slidingly inserted with its tongue 69 into the groove of the nose piece.

The stop 84 is then affixed to the existing horizontal surface, located at the rear edge 67 of the covering board 18' pushed into the recess to abut the base 62 thereof. The covering board is thus tightly maintained in fixed location on the existing surface. In the illustrated embodiment of FIG. 7 using finishing nails, there may be a plurality of finishing nails at spaced locations along the rear edge 67 used to maintain the covering board in tight interlocked relation with the nose piece 16'.

The receptacle 85, held with its rear side wall 89 in abutment with the riser R and its bottom outer surface 91 in abutment overlapping the top wear surface 18A' of the covering board, is then affixed to the riser R using fasteners F passed through apertures 90 (shown in phantom by stippled lines in FIG. 8). With the receptacle in fixed location, the process of trimming the next step can be repeated, beginning by wedging the next riser board between the side walls 88, 89 of the receptacle and continuing from there on in the manner previously described.

The receptacle is manufactured from aluminum by an extrusion process.

In another arrangement which is not shown, the rear of the member is stepped downwardly and inwardly from the top to a bottom of the member such that there is formed adjacent the recess base 62 a substantially horizontal surface bridging a full distance between the base 62 and the rear surface 20A'. In such an arrangement, the riser board may have a thickness from outer to inner faces 14A', 12A' exceeding a distance between the base 62 and the rear surface 20A' of the lower portion of the nose piece 16' such that the tongue 69 of the covering board 18' overlaps the top edge 82 of the riser board. That is, in the mounted position of the apparatus, the tongue 69 extends forwardly past the inner face 12A' of the riser board 12' so as to be located intermediate same and the outer face 14A'.

In another arrangement of the embodiment of FIGS. 6-8 that is shown in FIGS. 9-12, a covering board 18" includes an interconnection fastener 110 and nose piece 16" includes locking recess 112 which cooperate to mechanically couple the covering board and the nose piece so that the covering board can be installed in fixed location on the tread of the staircase structure simply by mounting the nose piece to the base structure of the staircase.

Figure 10:
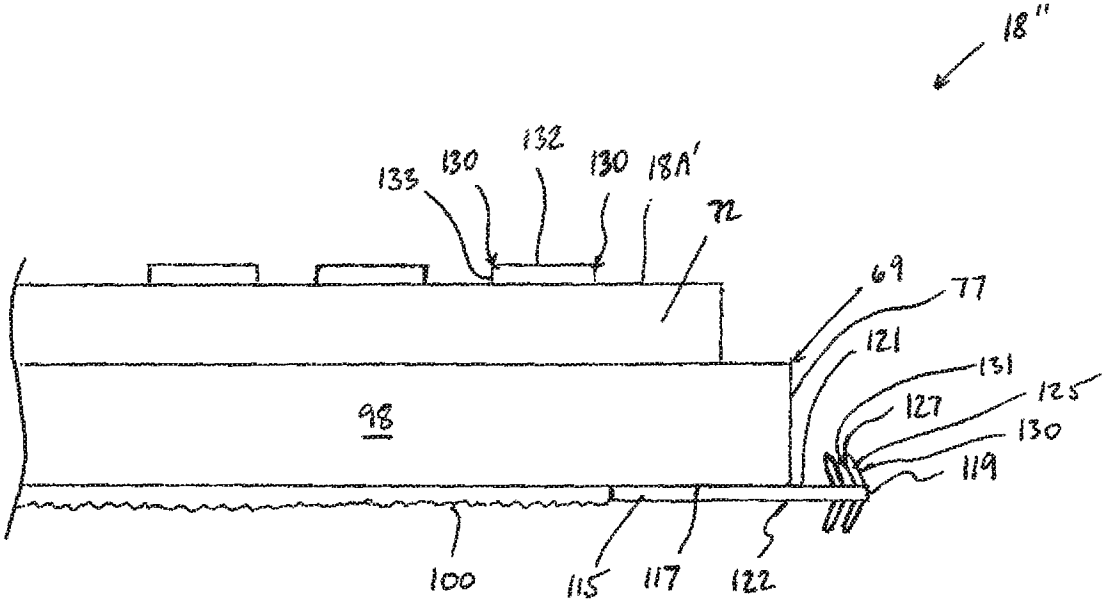
FIG. 10 is a side elevational view of a covering board of the arrangement of FIG. 9.
Figure 11:
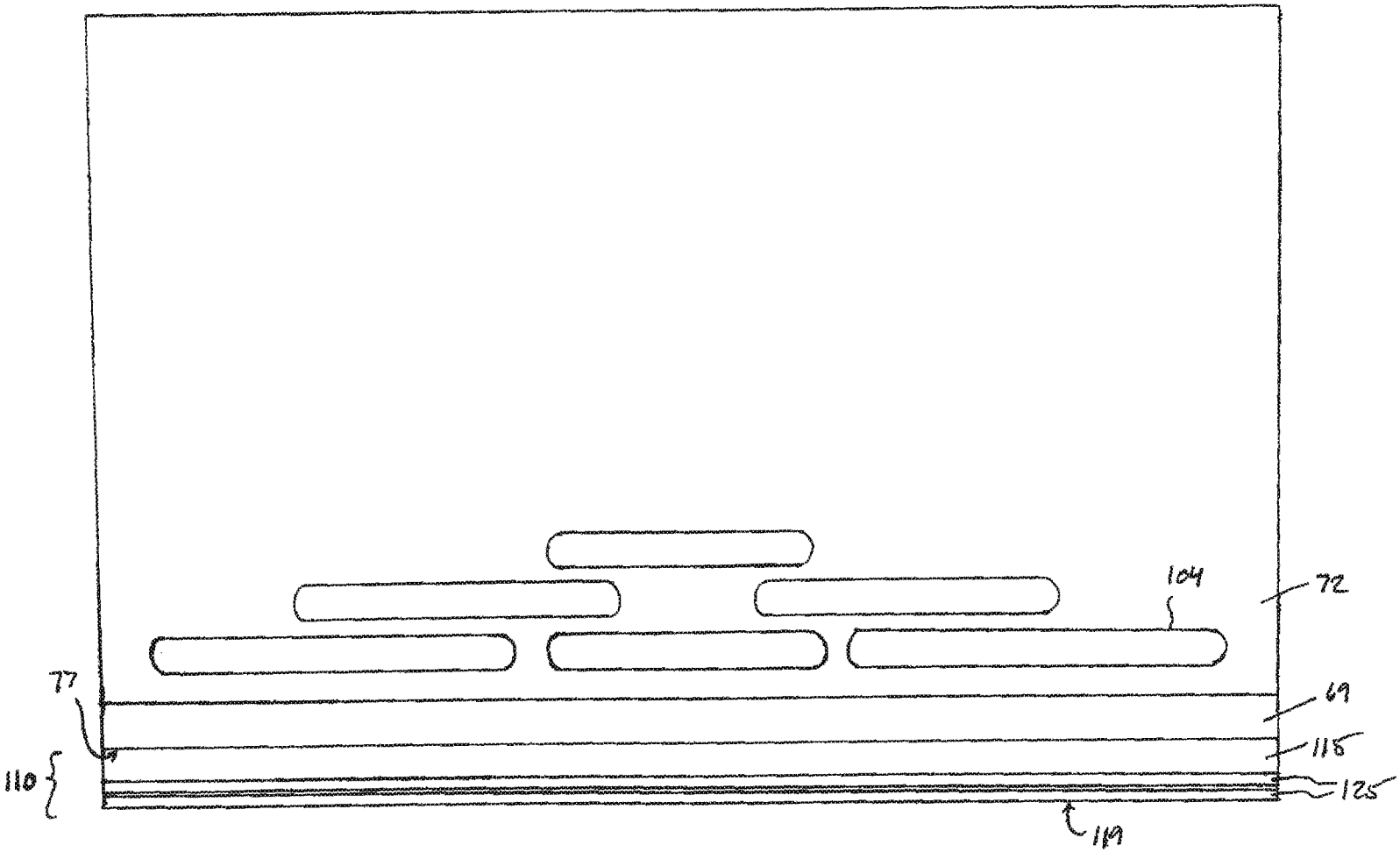
FIG. 11 is a top plan view of the covering board of FIG. 10.

As more clearly shown in FIGS. 10 and 11, the interconnection fastener 110 comprises a rigid base strip 115 which is elongated in a longitudinal direction of the covering board and spans the full length thereof. The base strip 115 is fastened such as by adhesive to the bottom surface 117 of the wooden base material 98 and projects forwardly beyond the tongue 69 to a forward edge 119 of the base strip which is spaced from the free edge 77 of the tongue in a forward direction of the covering board. The base strip has upper and lower surfaces 121, 122 which are spaced apart by a thickness of the strip which in the illustrated arrangement is much smaller than the thickness of the tongue 69. Thus when the base strip is cantilevered forwardly from the bottom of the wooden base material any increase in an overall thickness of the covering board at the front edge is negligible and thus not visually noticeable.

Each one of the upper and lower surfaces 121, 122 supports a respective deflectable projection in the form of a fin 125. Each fin 125 is formed by an upstanding strip of relatively stiff rubber elongated in the longitudinal direction of the covering board and spanning the full length of the base strip 115. Thus a longitudinally extending free edge 127 of the respective fin is spaced in a perpendicular direction to that surface of the base strip from which the respective fin stands upwardly. Each fin is inclined relative to the respective surface of the base strip 121 or 122 in a rearward direction of the covering board such that both a leading front surface 130 and a trailing rear surface 131, which meet at the free edge 127, are inclined relative to that surface of the strip too. Thus each fin has a relatively narrow thickness at its base at the strip and substantially uniform thickness across its height so as to allow the fin to deflect in at least the rearward direction of the covering board from a neutral position in relation to the base strip in which the fin stands naturally upwardly, which will become better appreciated shortly.

Cooperating with the interconnection fastener 110 is the locking recess 112 which is distinct from a tongue-receiving recess 60". The locking recess 112 is located below a bottom of the recess base 62 so as to be positioned at the bottom end of the recess 60", and includes a vertically oriented base 134 that is spaced inwardly from the vertical base 62 to which it is parallel. The locking recess also includes an upper or top sidewall 136 spanning horizontally from the base 134 to the tongue-receiving recess base 62. The top sidewall 136 meets the base 134 of the locking recess at a right angle in the illustrated arrangement of FIGS. 9-12. Further to the top sidewall 136 is a bottom sidewall of the locking recess parallel to and spaced from the top sidewall. In the illustrated arrangement the locking recess's bottom sidewall is formed by the top edge 82 of the riser board 12' when the riser is arranged in fixed relation to the nose piece 16" in an upright mounting condition, in which the riser board is in upright orientation and the top of the riser board is located beneath the recess in the member. Typically the nose piece and riser board are already fastened in fixed relation so as to leave a gap between the bottom of the recess 60" and the top edge 82 of the riser board so as to form the locking recess 112. In such an arrangement, the locking recess base 134 can be defined by an upper portion of the same vertical rear surface 20A' which overlaps the front outer face 14A' of the riser board. However, in other arrangements which are not shown the locking recess may be entirely distinct from the rear surface 20A' of the nose piece that overlaps and covers a portion of the riser board.

Figure 9:
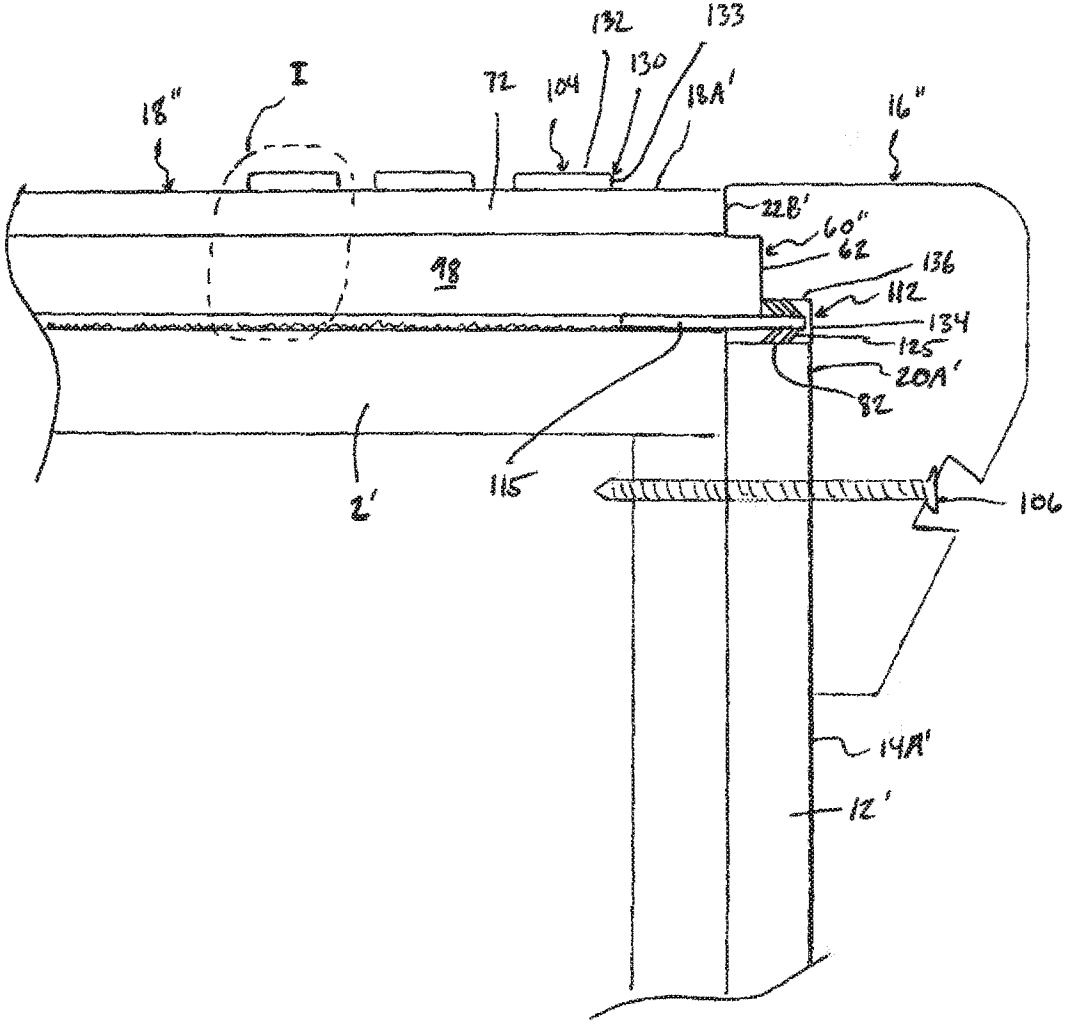
FIG. 9 is a cross-sectional view of another arrangement of the second embodiment as if it were taken along line 7-7 in FIG. 6.

To install the illustrated arrangement most clearly shown in FIG. 9, the fastener 110 is inserted into an interior cavity collectively defined by the top sidewall, the bottom sidewall, and the base of the locking recess. In doing so, the projections 125 are deflected rearwardly when they engage the top or bottom sidewall of the locking recess, and when the interconnection fastener 110 has been inserted to a suitable depth within the locking recess the free edges 127 of the projections frictionally engage the walls of the locking recess so as to resist removal from inside this interior space. A height of the locking recess 112 between the top and bottom sidewalls is less than an overall height of the interconnection fastener including the thickness of the base strip 115 and a height of an upper and a lower one of the deflectable projections from the respective surface 121 or 122 to the projection's free edge 127 in the neutral position, so as to cause the projections to deflect. From their rearward deflected position as shown in FIG. 9 the projections 125 suitably frictionally engage the top and bottom walls of the locking recess and cannot be deflected forwardly to a sufficient degree to allow removal of the fastener from within the locking recess, and thus the covering board is fixedly mechanically coupled to the nose piece and to the riser board which has been previously attached to the nose piece.

As such, the nose piece 16" can be mounted to the structural base of the staircase in a similar manner to the earlier described arrangements of staircase trimming apparatus herein, that is, by passing the fasteners 106 at the groove of the nose piece that is accessible at the front face thereof, and the covering board which is mechanically coupled to the nose piece thereby is located in fixed relation to the tread 2' without fastening the covering board to the tread such as by adhesive.

As shown most clearly in FIGS. 7 and 11, a covering board of the apparatus may be formed with at least one elongated raised ridge 104 which protrudes above the top wear surface 18A' for providing traction. These ridges 104 can be separate elements from the upper covering material 72 which are joined thereto, such as distinct strips of metallic material such as aluminum which are of a different colour than the covering material, so as to form an attractive covering panel of the covering board. The covering board of this illustrated arrangement is formed by high temperature bonding of the distinct strips to the covering material 72 defining a base sheet of the covering panel.

The base sheet is provided dimensioned in width and in length to be substantially equal to the corresponding dimensions of the structural tread 2' of the staircase. The base sheet includes an upper face defined by the top wear surface 18A' which is exposed in the installed position of the covering board, and an opposite lower face in contact with an upper surface of a panel of wooden base material 98 to which the covering panel is mounted.

Each strip 104 is sized smaller than the base sheet, and is elongated and oriented on the base sheet so as to extend in a longitudinal direction of the tread, as more clearly shown in FIG. 11. Thus is provided a longitudinally extending shoulder 130 in front and at the rear of each strip formed between an upper surface 132 of the strip 104 and its downwardly depending side edge 133 that can cooperate with a sole of a bare foot or that of footwear for providing additional traction. These traction ridges are distinct from the nose piece and are spaced rearwardly from a rearmost surface 22B" of the nose piece defining along its top a rearmost edge of the nose piece so as to leave a portion of the top wear surface 18A' of the covering board between the nose piece and the nearest ridge in relation thereto. As shown in FIG. 11, a plurality of such ridges can be provided in a staggered arrangement in which the ridges are staggered both longitudinally of the tread and transversely thereof.

Figure 12:
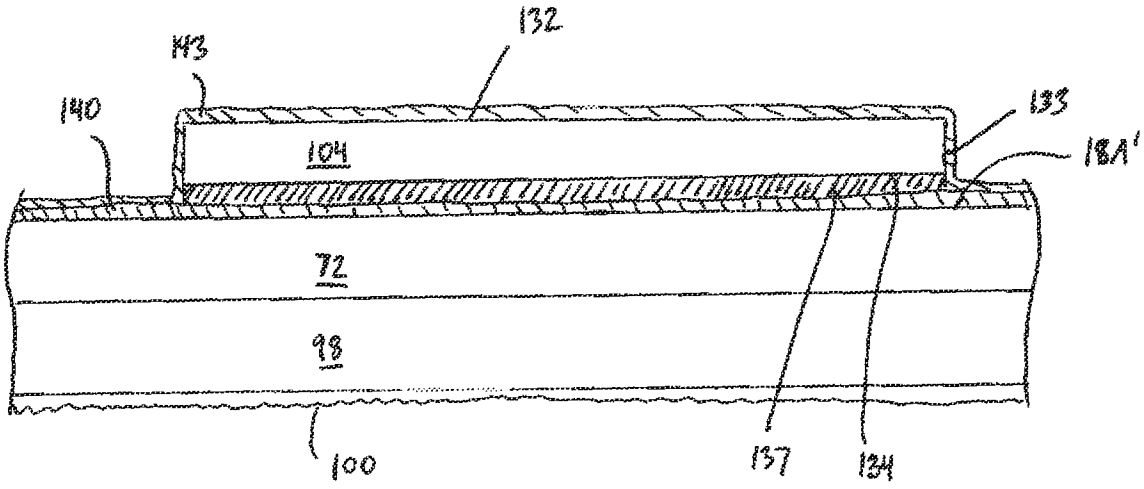
FIG. 12 is an enlarged partial view indicated at I in FIG. 9 in which components are shown schematically.

Referring to FIG. 12, each strip is joined to the base sheet of metallic material by bonding of a lower face 134 of the respective strip to the upper face 18A' of the base sheet 72. That is, an adhesive 137 (shown schematically) is applied at an interface between the strip's lower face 134 and the upper face 18A' of the base sheet, and is then cured by placing in an oven the substantially formed covering panel, with strip 104 disposed in a fixed location on the base sheet 72. The oven (not shown), which will be known in the art of high temperature adhesive bonding and is therefore not described in detail herein, is operated at a baking temperature of 400 degrees Fahrenheit for a suitable amount of time until the adhesive has cured. However, generally speaking, the baking temperature may lie in a range between 200 and 600 degrees Fahrenheit, or in a smaller range between 300 and 500 degrees Fahrenheit, or in a further narrower range between 350 and 450 degrees Fahrenheit depending for example on surface areas of the bonding surfaces.

Each of the base sheet and the ridges are powder-coated so as to provide further traction on top of what is afforded by the longitudinally extending shoulders defined by the ridges 104. In the illustrated arrangement, the base sheet 72 is powder-coated prior to the bonding, such that the bonding adhesive is applied at an interface of a bare metal lower face 134 of the respective strip and a layer 140 of powder-coating covering the metallic upper surface 18A' of the base sheet. Thus, once the ridge strips have been bonded to the powder-coated base sheet, another layer of powder-coating is applied to the upper surface of the substantially formed covering panel collectively defined by the base sheet with strips thereon. As such, the base sheet receives two layers of powder-coating, one before the bonding step indicated at 140 and one thereafter indicated at 143, so as to seal the interface between the metallic strips 104 and the base sheet where the cured adhesive is located.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. Apparatus for trimming a step edge comprising:

a riser board for locating a top of the riser board disposed in upright orientation at or adjacent an edge of a substantially horizontal existing surface defining said step edge;

an elongate member forming a nose piece for locating at the edge of the existing surface, the member including a top, a rear for facing towards the step edge, and a front ornamental face that is opposite the rear;

a covering board for covering the existing surface;

the covering board having a top wear surface, a bottom surface for facing the existing surface, a front edge for locating proximal the member, and a rear edge for locating distal to the member;

the member being arrangeable in a mounted position in which the top of the member is spaced above the existing surface such that a thickness of the covering board is locatable between the top of the member and the existing surface;

the member including a locking recess in the rear that is spaced from the top so as to leave an upper portion of the rear of the member between the recess and the top for locating at a height of the existing surface in the mounted position of the member;

the locking recess having a base spaced inwardly from the rear of the member, a top sidewall extending from the base to the rear of the member, and a bottom sidewall opposite the top sidewall;

and a fastener connected to the covering board and projecting forwardly from the front edge thereof at a location spaced below the top wear surface for cooperation with the locking recess to mechanically couple the covering board and the member;

the fastener comprising:

a base strip having a forward edge spaced forwardly from the front edge of the covering board and defining a surface of the base strip located generally between the forward edge of the base strip and the front edge of the covering board; and at least one deflectable projection upstanding from the surface of the base strip which can deflect relative to the base strip in at least a rearward direction so as to deflect during insertion into but resist removal from within an interior space defined by the locking recess.

2. The apparatus according to claim 1 wherein the deflectable projection includes a leading front surface and trailing rear surface extending from the surface of the base strip and meeting at a free edge of the projection, the leading front surface and the trailing rear surface being inclined relative to the surface of the base strip in a rearward direction of the covering board.

3. The apparatus according to claim 1 wherein a height of the locking recess between the top and bottom sidewalls is less than a height of the fastener measured in a direction of a thickness of the covering board between the top wear surface and the bottom surface thereof.

4. The apparatus according to claim 1 wherein the bottom sidewall of the locking recess is formed by a top edge of the riser board arranged in fixed relation to the member in an upright mounting condition in which the riser board is in the upright orientation and the top of the riser board is located beneath the recess in the member.

5. The apparatus according to claim 1 wherein said at least one deflectable projection includes an upper deflectable projection supported on an upper surface of the base strip for contacting the top sidewall of the locking recess, and a lower deflectable projection supported on a lower surface of the base strip for contacting the bottom sidewall of the locking recess.

* * * * *